US006698344B1

(12) United States Patent
Faber

(10) Patent No.: US 6,698,344 B1
(45) Date of Patent: Mar. 2, 2004

(54) SELF-INKING HAND STAMP

(75) Inventor: Ernst Faber, Wels (AT)

(73) Assignee: Colop Stempelerzeugung-Skopek GmbH Co. KG, Wels (AT)

( * ) Notice: Subject to any disclaimer, the term of this patent is extended or adjusted under 35 U.S.C. 154(b) by 0 days.

(21) Appl. No.: 09/890,981

(22) PCT Filed: Jan. 10, 2000

(86) PCT No.: PCT/AT00/00002

§ 371 (c)(1),
(2), (4) Date: Aug. 8, 2001

(87) PCT Pub. No.: WO00/47420

PCT Pub. Date: Aug. 17, 2000

(30) Foreign Application Priority Data

Feb. 9, 1999 (AT) ..... 167/99

(51) Int. Cl.[7] ..... B41K 1/08; B41K 1/42

(52) U.S. Cl. ..... 101/104; 101/105; 101/111; 101/334

(58) Field of Search ..... 101/104, 105, 101/111, 334

(56) References Cited

U.S. PATENT DOCUMENTS

| | | | | | |
|---|---|---|---|---|---|
| 958,533 | A | * | 5/1910 | Price | 101/105 |
| 2,079,080 | A | * | 5/1937 | Melind | 101/334 |
| 3,714,894 | A | | 2/1973 | Robinson | 101/382 |
| 4,603,628 | A | * | 8/1986 | Just | 101/105 |
| 5,671,668 | A | * | 9/1997 | Shih | 101/104 |
| 5,718,169 | A | * | 2/1998 | Faber | 101/105 |
| 5,809,886 | A | * | 9/1998 | Faber | 101/334 |
| 5,819,650 | A | * | 10/1998 | Shih | 101/111 |

FOREIGN PATENT DOCUMENTS

| | | |
|---|---|---|
| AT | 379 552 | 1/1986 |
| DE | 2 020 162 | 11/1971 |

* cited by examiner

*Primary Examiner*—Andrew H. Hirshfeld
*Assistant Examiner*—Jill E Culler
(74) *Attorney, Agent, or Firm*—Collard & Roe, P.C.

(57) ABSTRACT

A self-inking hand stamp with upper stroke inking. The stamp (1) comprises a supporting plate (5) for fixed stamp characters (7), and this supporting plate has a central aperture (8) in which further stamp characters (9) provided on a separate, supporting insert (11) are arranged. The insert (11) is connected with the supporting plate (5) via an adapter (12) into which it is inserted.

24 Claims, 3 Drawing Sheets

SELF-INKING HAND STAMP

CROSS REFERENCE TO RELATED APPLICATIONS

Applicant claims priority under 35 U.S.C. §119 of Austrian Application No. A167/99 filed Feb. 9, 1999. Applicant also claims priority under 35 U.S.C. §365 of PCT/AT00/00002 filed Jan. 10, 2000. The international application under PCT article 21(2) was not published in English.

The invention relates to a self-inking hand stamp comprising a stamp casing, an ink pad upwardly arranged in the stamp casing, and a stamp unit carrying stamp characters and including a turning mechanism by which the stamp characters are position-invertingly pivotingly downwardly movable from an inking position contacting the ink pad into a downwardly directed printing position, the turning mechanism being connected with an actuating bow capable of being manually pressed downwards and including a guiding slot extending from top to bottom in each one of two oppositely arranged side walls of the stamp casing, each guiding slot guiding for upward and downward movement therein an axle pin provided on the stamp unit and defining the geometrical pivot axis of the stamp unit and engaging in the actuating bow, the stamp unit being provided with a supporting plate for stamp characters, which supporting plate has at least one, e.g. centrally located, aperture into which further stamp characters carried by a separate support can be placed.

Self-inking hand stamps in which an ink pad upwardly arranged in the stamp casing is provided for inking the stamp characters, to which the stamp characters are pressed for inking in the at-rest position of the stamp, which stamp characters are turned by approximately 180° by means of a turning mechanism arranged in the stamp casing when the stamp is actuated so as to press them against a surface to be provided with a stamp imprint have long been known. Such self-inking hand stamps have also been provided with a supporting plate for the stamp characters which has an aperture located in its central region in which further stamp characters carried by a separate support can be placed; such stamps have widely been used to combine, in one pressing movement, a constant stamp imprint with a further stamp imprint that requires frequent changes, such as, e.g., a continuous numbering or a date. Such known stamps which correspond to the initially stated classification are comparatively complex and laborsome as regards the production of the individual construction elements and also as regards their mounting procedure, which can be taken, e.g., from DE 634 393 which describes a self-inking hand stamp corresponding to the initially stated classification. With such stamps it must be taken into account that, generally, they will be subjected to an intensive use and, accordingly, should have an appropriately stable structure.

Also from At 379 552 B and from DE 2 020 162 A self-inking hand stamps are known in which the stamp unit to be turned from the inking position to the printing position has a supporting plate for mounting fixed stamp characters, which is pivoted about a geometrical pivot axis during the turning procedure, and which has a central opening through which individual stamp characters of a stamp-band insert project, which insert is directly fastened to the supporting plate. Also for these known stamps, the provision of the construction parts and the mounting procedure are comparatively complex and laborsome.

It is an object of the present invention to provide a stamp of the initially defined type, which, with as simple a structure as possible, at the same time has a good stability also when subjected to intensive use and which is easy to assemble and, moreover, also makes it possible to use the advantages of large serial production even for orders of a smaller volume which may differ in respect of the stamp characters to be provided.

The self-inking hand stamp according to the invention and of the initially defined type is characterized in that, for retaining the further stamp characters capable of being placed into the aperture provided in the supporting plate, at least one adapter is attached in the stamp unit at the rear side of the supporting plate, leaving clear the opening thereof, and the further stamp characters are provided on an insert inserted in this adapter. With this design, the object set out above can well be met. When the stamp is assembled, the supporting plate can be inserted in the stamp casing during the assembly procedure in a simple manner and brought into connection with the actuating bow of the stamp, as soon as the actuating bow has been assembled with the stamp casing and with a return spring, a stamp construction capable of functioning as regards the stamp characters to be arranged on the supporting plate being already provided upon insertion of the supporting plate and attachment of the ink pad. Since the supporting plate may be made with a relatively slight thickness, or structural height, respectively, it is possible to insert the supporting plate into the guiding slots of the stamp casing also if this supporting plate has axle pins molded to either side thereof, by slightly inclining its position so that the axle pins will project outwardly through the guiding slots and get into connection with the actuating bow. The thus pre-fabricated self-inking hand stamps may then very easily be provided with inserts carrying the further stamp characters, which are to be arranged in the aperture of the supporting plate, by inserting these inserts in adapters which, in turn, are attached to the rear side of the supporting plate in the region of the apertures of the latter. Due to the prefabrication mentioned, it is thus possible to use the advantages of large serial production and, starting from there, to complete individual smaller series requiring few mounting manipulations.

For the above-indicated pre-fabrication and particularly as regards the installation of the supporting plate in the stamp casing, it is advantageous if the turning mechanism includes turning indentations on the inner side of the side walls of the stamp casing which include the guiding slots, next to these guiding slots, and turning pins on the rims of the supporting plate facing these side walls, the turning pins, upon initiation of the pivoting movement by auxiliary abutments on the supporting plate and on the said side walls, getting into engagement with the turning indentations in the course of the upward movements and downward movements of the stamp unit and completing the pivoting movement of the stamp unit.

For a simple production of the adapter itself and as regards its seat on the rear side of the supporting plate, it is suitable if the adapter is designed as a U-shaped body whose central base is seated on the supporting plate and provided with an aperture in alignment with the aperture provided in the supporting plate. Furthermore, for a simple and rapid insertion of the adapter in the pre-fabricated stamp, it is advantageous if it is provided for the adapter to be fixed on the supporting plate by means of a latch connection.

For an easy, precise and labor-saving insertion of the insert into the adapter, it is suitable if it is provided for the adapter to have a guide in which the insert provided with the further stamp characters is inserted. This is particularly advantageous if the further stamp characters arranged on the insert are provided on at least one loop-shaped band which is displaceable in peripheral direction. The stamp characters provided on such an insert may, e.g., characterise individual administrative procedures, such as "received", "mailed", or-"filed", or they may also carry stamp types on several loop-shaped bands for a continuous numbering, or for dates.

To ensure a continuous, equal level of the printing side of all the stamp characters for a uniform inking and for making a uniform imprint of all stamp ,_characters of the stamp even with differing thicknesses of the stamp characters arranged on the supporting plate, on the one hand, and of the further stamp characters arranged on the insert in the aperture of the supporting plate, on the other hand, suitably an adjustment device is provided which allows for an adjustment of the insert relative to the supporting plate. In the present case, an embodiment is suitable which is characterized in that an ajdustment device is inserted between the adapter and the insert by means of which the level of the printing side of the stamp characters provided on the insert is adjustable relative to the plane of the supporting plate. This allows for an easy mounting and pre-adjustment of the insert, even before the insert, with the adapter, is inserted in the stamp so that when completing individual stamp series, merely slight re-adjustments will be required. A solution which is simple in terms of construction and function is achieved if it is provided for the adjustment device to be formed by adjusting screws capable of being screwed into the adapter and each being in connection with the insert by means of a head or collar or groove. In this case it is furthermore advantageous if the adapter comprises guiding sleeves into which the adjustment screws can be screwed. This results in a good fit of the adjustment screws, even if re-adjustments are performed frequently. As a solution for securing the adjustment screws against axial displacement which is simple in construction and functions well, it is advantageous if holding clamps are arranged on the insert in which the adjustment screws are rotatable and retained against axial displacement.

For inserting the adapter into the pre-fabricated stamp, it is advantageous to provide for a positioning which provides for, or ensures, respectively, the mutual position of supporting plate and adapter, and an embodiment which is advantageous in this respect is characterized in that, on the rear side of the supporting plate, positioning elements are provided which guide the adapter when it is placed onto the rear side of the supporting plate and secure it against lateral displacement. In this respect, a structurally very simple solution which is easy to manipulate results if pins are provided on the rear side of the supporting plate as positioning elements which engage in apertures provided in the adapter corresponding to these pins.

The invention will now be explained in more detail by way of preferred exemplary embodiments and with reference to the schematic drawings, wherein.

Figure 1:
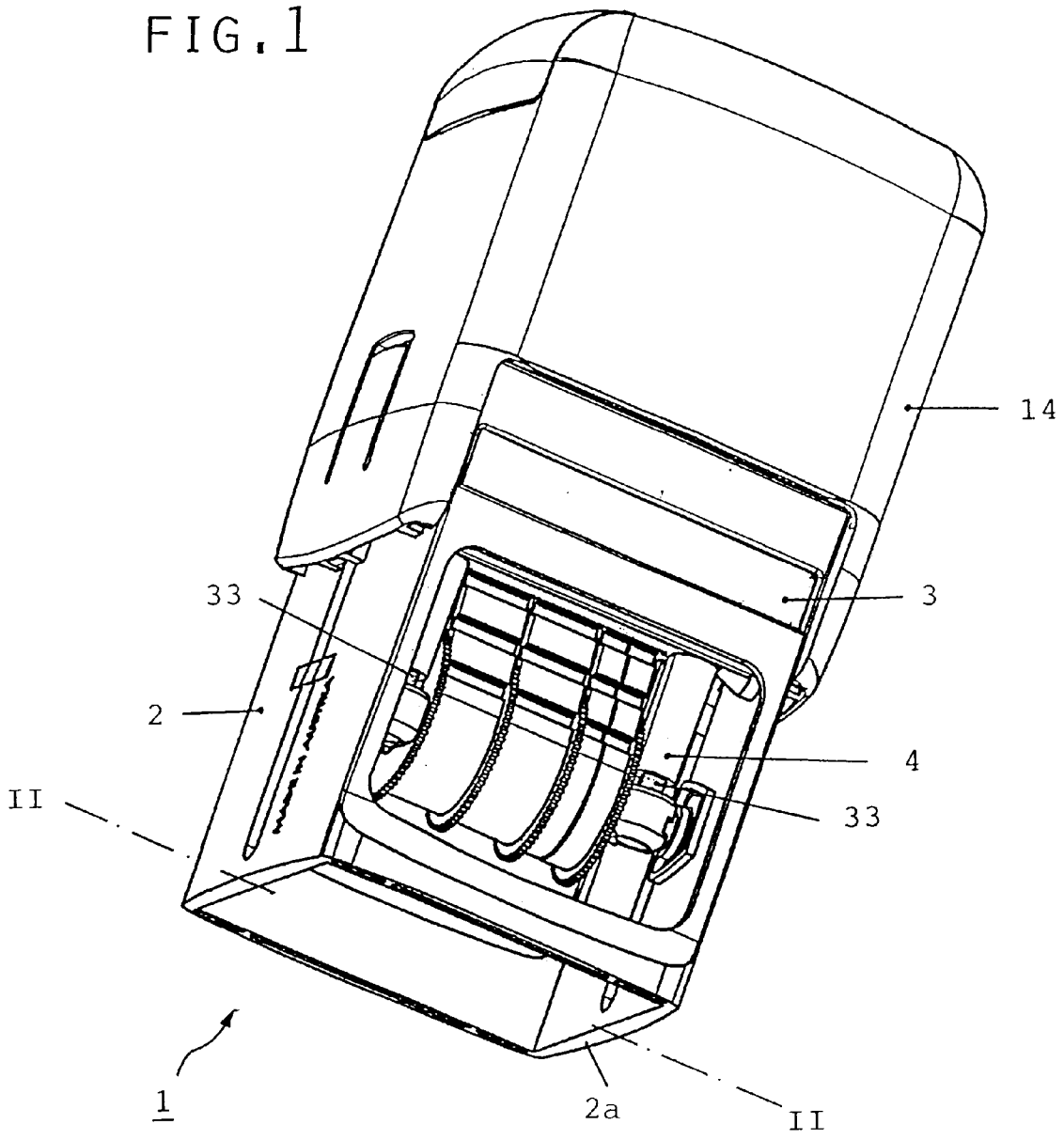
FIG. 1 is an example of a self-inking hand stamp designed according to the invention, shown in an axonometric view.

The self-inking hand stamp 1 illustrated in the drawing has a stamp casing 2 with an ink pad 3 arranged in the top portion thereof. Within the stamp casing 2, a stamp unit 4 comprising a supporting plate 5 is arranged whose front side 6 is provided for the attachment of stamp characters 7. The stamp characters 7 are entered in broken lines, since in practice such stamp characters frequently have to be produced individually, according to the customer's wishes, and will only be inserted into the stamp when the stamp is sold to the individual customer. The supporting plate 5 has an aperture 8 which, in the exemplary embodiment illustrated, is located in the central region of the supporting plate 5 and longitudinally oriented; in this aperture 8, further stamp characters 9 carried by a separate support can be placed. In the case illustrated, the further stamp characters 9 are provided on loop-shaped bands 10 which, together with the corresponding supports and guides, form an insert 11, which may be designed as usual to form a date imprint. By an appropriate configuration of the further stamp characters 9, the insert could also be designed to form a continuous numbering or other imprints to be alternately adjusted. Thus, it is also possible to provide an insert 11 which carries a supporting plate for fixed stamp characters extending into the aperture 8. Depending on the desired position of the further stamp characters 9, the aperture 8 may also be arranged eccentrically and/or also transversely (e.g. in case of stamps for lists). Moreover, several such apertures 8 may be provided, in accordance with several inserts 11 with further stamp characters 9. For the sake of simplicity, however, merely an embodiment with one single aperture 8 and comprising one single insert 11 will be explained in more detail in the following.

To attach the insert 11 on the rear side 13 of the supporting plate 5, an adapter 12 leaving clear the aperture 8 of the supporting plate 5 is provided, in which adapter the insert 11 is inserted. If several apertures 8 are provided, several such adapters 12 may be provided accordingly.

Figure 3:
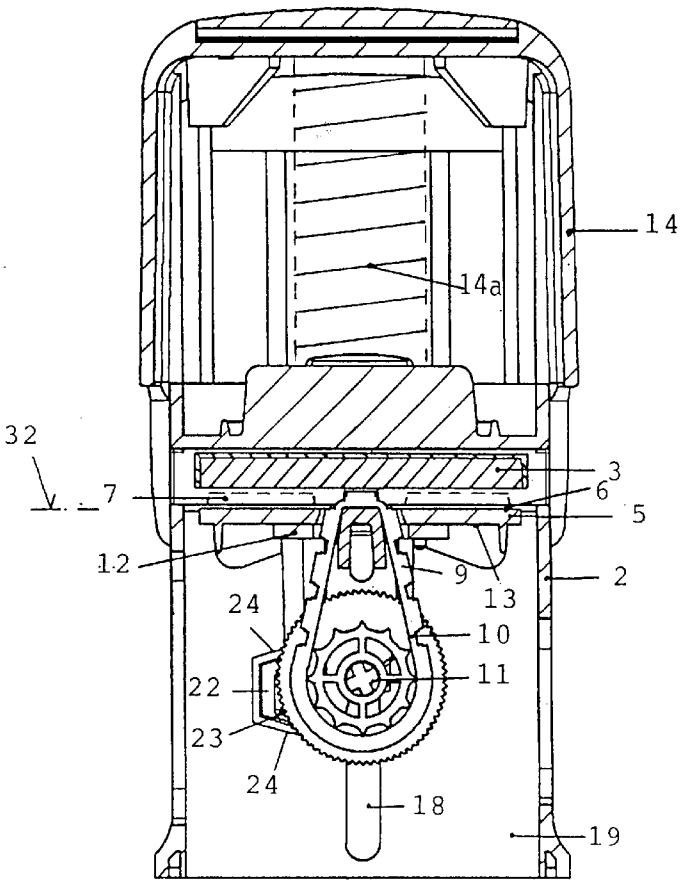
FIG. 3 shows this stamp in a section according to line III—III of FIG. 2.
Figure 2:
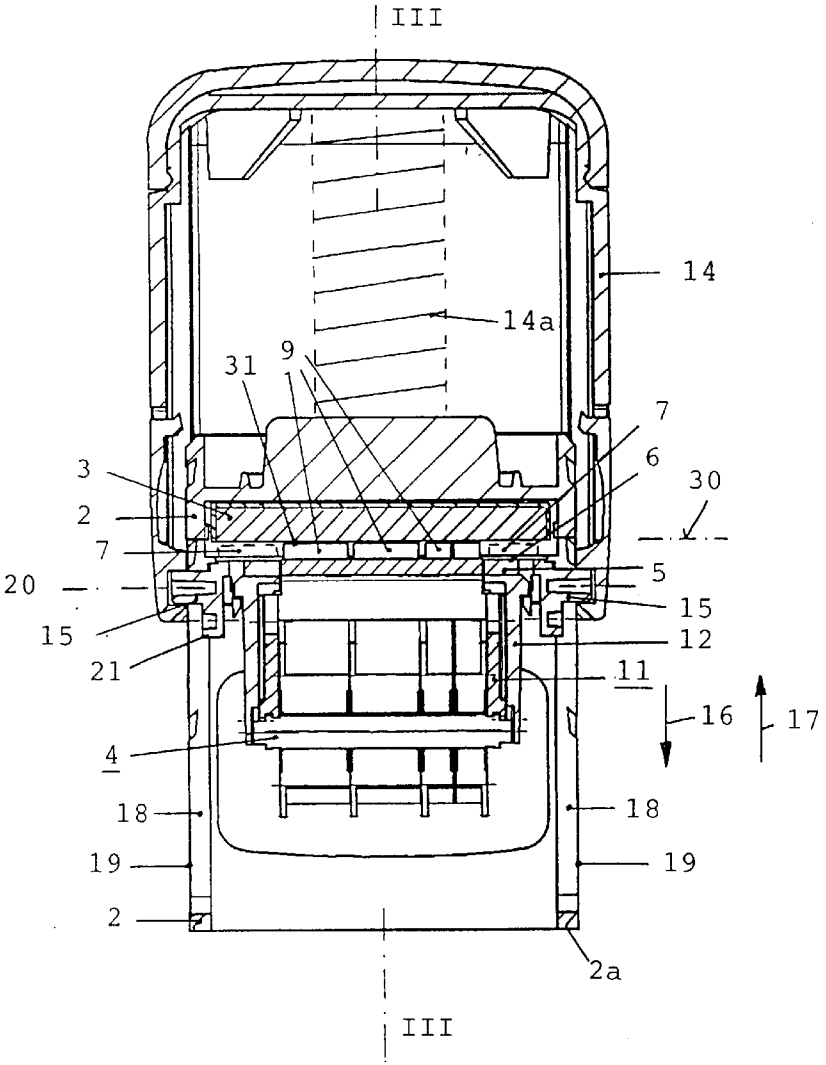
FIG. 2 shows this stamp in a section according to line II—II of FIG. 1.
Figure 4:
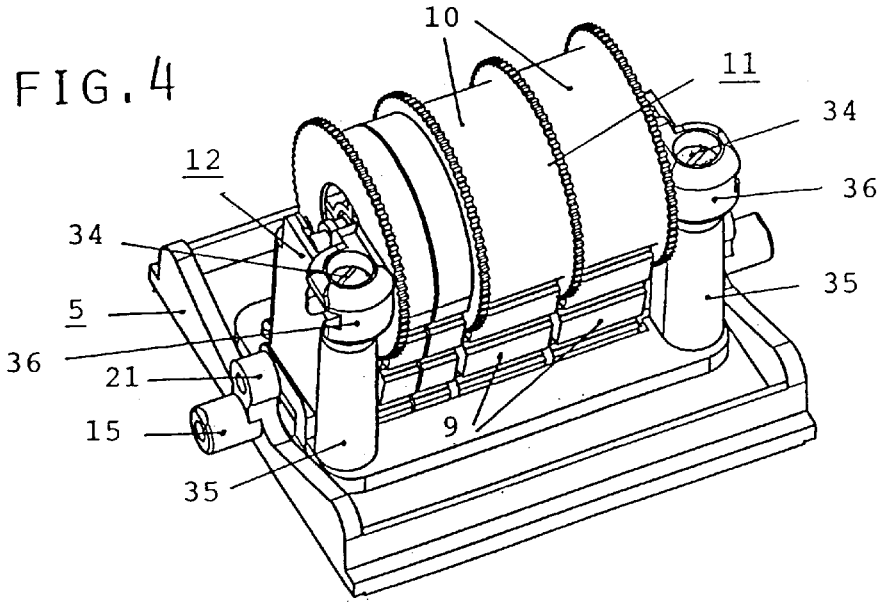
FIG. 4 shows an axonometric view of the stamp unit of this stamp, assembled of a supporting plate, an adapter and a stamp-character carrying insert.
Figure 5:
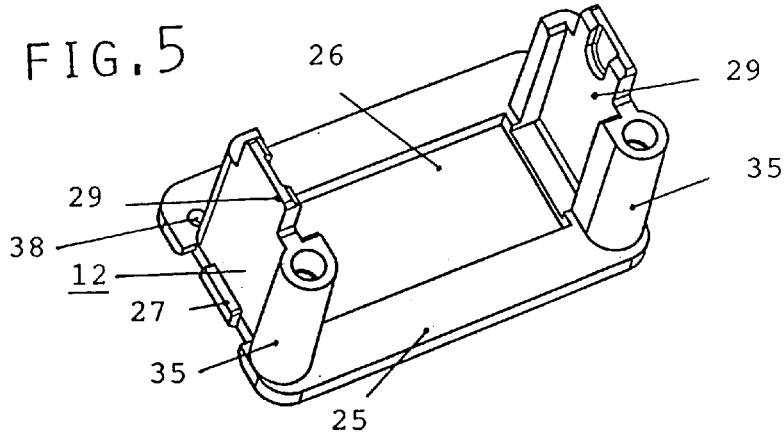
FIG. 5 shows the adapter provided in this instance in an axonometric view.

In the illustrations of FIGS. 1, 2 and 3, the stamp unit 4 is in the inking position, in which the stamp characters 7, 9 are upwardly directed, contacting the ink pad 3. To make an imprint, the stamp unit 4 must be invertingly and pivotingly moved downwards until the stamp characters 7, 9 point downwards and reach a printing position located at the lower rim 2*a* of the stamp casing 2. For this purpose, a turning mechanism is provided in the stamp 1, which turning mechanism is actuated by a hood-like actuating bow 14. The actuating bow 14 is shiftably mounted on the stamp casing 2 and is pressed upwards by a spring 14a, whereby also the stamp unit 4 connected with the actuating bow 14 via the turning mechanism is maintained in its inking position illustrated in the drawing. By pressing the actuating bow 14 downwards, the stamp unit 4 experiences a position-inverting, pivoting downward movement in the direction of arrow 16, until the stamp characters 7, 9 have reached the printing position located at the level of the rim 2*a* of the stamp casing 2; when releasing the actuating bow 14, an upward movement will occur in the reverse direction, corresponding to arrow 17.

In each one of two oppositely arranged side walls 19 of the stamp casing 2, the turning mechanism includes a guiding slot 18 extending from top to bottom, and axle pins 15 provided on the stamp unit 4 are guided in these guiding slots 18 so as to be upwardly and downwardly movable therein; in the example illustrated, the axle pins 15 are molded to the supporting plate 5; the axle pins 15 define the geometric pivot axis 20 of the stamp unit 4. On the inner side of the side walls 19 of the stamp casing 2 provided with the guiding slots 18, the turning mechanism further comprises U-shaped projections 22 next to these guiding slots 18, which projections 22 form turning indentations 23 in which turning pins 21 come to engage in the course of the upward and downward movements of the stamp unit 4, which turning pins 21 are provided integrally on the rims of the supporting plate 5 facing the side walls 19. Together with the rims of the supporting plate 5, the outer rims 24 of the U-shaped projections 22 form auxiliary abutments which will start a pivoting movement as soon the supporting plate 5 reaches the U-shaped projections 22 in the course of an upward or downward movement, whereby the turning pins 21 get into engagement with the turning indentations 23 and thereby complete a pivoting movement of the stamp unit 4.

In the example illustrated, the adapter 12 is a U-shaped body seen in plan view, having a central base 25 seated on the supporting plate 5 and provided with an aperture 26 which is in alignment with the aperture 8 provided in the supporting plate 5. The adapter 12 is fixed on the supporting plate 5 by means of a latch connection which, in the example illustrated, is realized by latching noses 27 provided on the adapter 12 and latching bows 28 provided on the supporting plate 5. When pressing the adapter 12 to the supporting plate 5, this latching connection snaps in and thus retains the adapter 12 on the supporting plate 5. The adapter 12 is also provided with a guide 29 having the form of sliding grooves and allowing for a displacement of the insert 11 to be inserted in the adapter 12, in the direction of shifting displacement.

Between the adapter 12 and the insert 11, an adjustment device is inserted, by means of which the level 30 of the printing side 31 of the stamp characters 9 provided on the insert is adjustable relative to the plane 32 of the supporting plate 5. This adjustment device is formed by adjusting screws 33 capable of being screwed into the adapter 12 and each being in connection with the insert 11 by means of a head 34 or a collar or groove. For this purpose, guiding sleeves 35 are provided on the adapter 12, into which the adjustment screws 33 can be screwed. On the insert 11, holding clamps 36 are arranged in which the adjustment screws 33 are rotatable and held fixed against axial shifting by being supported on their head 34.

On the rear side 13 of the supporting plate 5, positioning elements 37 are arranged which have the form of pins. These positioning elements, or pins, 37 engage in apertures 38 provided on the adapter 12 in correspondence with the pins 37. Two of these apertures 38 are located below the guiding sleeves 35. By means of these positioning elements 37, the adapter 12—with the insert 11 already inserted therein, is centered when it is placed on the supporting plate 5 and subsequently is retained in this centered position by the latching connection 27, 28 so that the stamp characters 9 arranged on the insert 11 will correctly assume their predetermined position relative to the supporting plate 5 and to the stamp characters 7 provided thereon.

Figure 6:
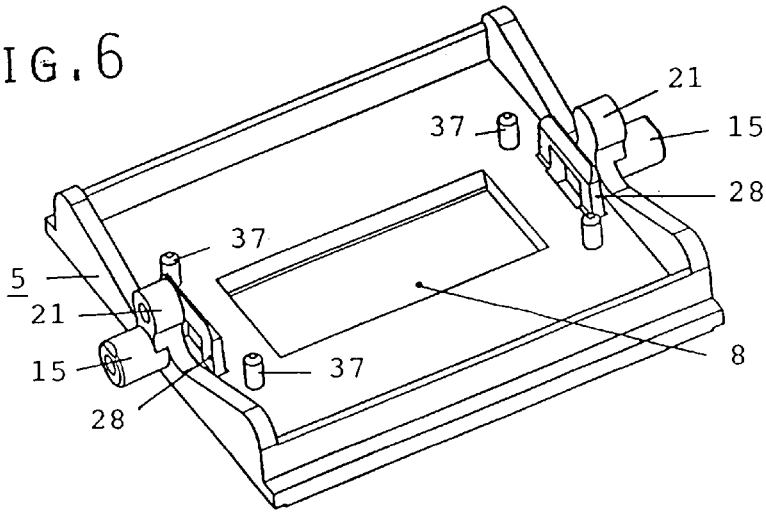
FIG. 6 shows the supporting plate of the self-inking stamp provided in this instance, also in an axonometric view.

As has already been indicated before, the aperture 8, through which the further stamp characters 9 can make their imprint, may be eccentrically arranged, and it may, in particular as compared with the illustration of, e.g., FIG. 6, be provided in transverse direction, for instance neighbouring the one pair of pin and positioning elements 37. In that instance, accordingly, the adapter 12 has to be designed with a transversely extending aperture and the insert 11 with the corresponding further stamp characters 9. It is also possible to provide two (or more) inserts 11 with the respective additional stamp characters 9, e.g. at different loop-shaped date bands, so as to enable different date imprints, and in that case, with a view to the independent adjustment as described, suitably two separate adapters 12 will be mounted; it would, as such, also be conceivable to provide the two inserts 11 adjacent each other, with separate adjustment mechanisms with guiding sleeves 35, on one adapter 12.

What is claimed is:

1. A self-inking hand stamp comprising a stamp casing having two oppositely arranged side walls, each one of said side walls being provided with a guiding slot extending from top to bottom, an ink pad upwardly arranged in said stamp casing, a supporting plate carrying stamp characters, said supporting plate being the main part of a stamp unit and having axle pins defining the geometric Divot axis of said stamp unit, and enabling a position-inverting pivoting movement of the supporting plate, said supporting plate having a front side and a rear side and including at least one aperture capable of receiving further stamp characters, an adapter supported on the supporting plate and attached to the rear side of said supporting plate so as to leave clear said at least one aperture in said supporting plate, an insert inserted in said adapter, said further stamp characters being provided on said insert, and said adapter adapting between the rear side of the supporting plate and the contour or size of the insert, an actuating bow capable of being manually depressed, and a turning mechanism connected with said actuating bow for position-inverting pivoting movement of all of said stamp characters from an inking position contacting said ink pad into a downwardly oriented printing position, with said axle pins of said supporting plate engaging in said actuating bow and being guided in each of said guiding slots of said side walls of said stamp casing so as to be upwardly and downwardly movable therein.

2. A self-inking hand stamp as set forth in claim 1, wherein said aperture provided in said supporting plate is located in a middle region of said supporting plate.

3. A self-inking hand stamp as set forth in claim 1, wherein said adapter is designed as a U-shaped body having a central base, said central base of said U-shaped body being seated on said rear side of said supporting plate and including a central-base-aperture in alignment with the aperture provided in said supporting plate.

4. A self-inking hand stamp as set forth in claim 3, wherein said adapter is fixed on said supporting plate by means of a latch connection.

5. A self-inking hand stamp as set forth in claim 3, wherein said adapter includes a guide, said insert carrying said further stamp characters being inserted shiftably in said guide.

6. A self-inking hand stamp as set forth in claim 5, wherein said further stamp characters provided on said insert have a printing side located at a certain level and said supporting plate is located in a certain plane, further comprising an adjustment device inserted between said adapter and said insert for adjusting said level of the printing side of said further stamp characters provided on said insert relative to said plane of said supporting plate.

7. A self-inking hand stamp as set forth in claim 6, wherein said adjustment device comprises adjustment screws capable of being screwed into said adapter, each adjustment screw having a means for connection with said insert.

8. A self-inking hand stamp as set forth in claim 7, wherein said adapter further comprises guiding sleeves, said adjustment screws being capable of being screwed into said guiding sleeves.

9. A self-inking hand stamp as set forth in claim 7, further comprising holding clamps arranged on said insert, said adjustment screws being rotatable in said holding clamps and being retained fixed against axial displacement therein.

10. A self-inking hand stamp as set forth in claim 1, wherein said adapter is fixed on said supporting plate by means of a latch connection.

11. A self-inking hand stamp as set forth in claim 1, wherein said adapter includes a guide, said insert carrying said further stamp characters being inserted shiftably in said guide.

12. A self-inking hand stamp as set forth in claim 11, wherein said further stamp characters provided on said insert have a printing side located at a certain level and said supporting plate is located in a certain plane, further comprising an adjustment device inserted between said adapter and said insert for adjusting said level of the printing side of said further stamp characters provided on said insert relative to said plane of said supporting plate.

13. A self-inking hand stamp as set forth in claim 12, wherein said adjustment device comprises adjustment screws capable of being screwed into said adapter, each adjustment screw having a means for connection with said insert.

14. A self-inking hand stamp as set forth in claim 13, wherein said adapter further comprises guiding sleeves, said adjustment screws being capable of being screwed into said guiding sleeves.

15. A self-inking hand stamp as set forth in claim 13, further comprising holding clamps arranged on said insert, said adjustment screws being rotatable in said holding clamps and being retained fixed against axial displacement therein.

16. A self-inking hand stamp as set forth in claim 1, further comprising at least one loop-shaped band adjustable in peripheral direction, said further stamp characters provided on said insert being provided on said at least one loop-shaped band.

17. A self-inking hand stamp as set forth in claim 1, wherein said further stamp characters provided on said insert have a printing side located at a certain level and said supporting plate is located in a certain plane, further comprising an adjustment device inserted between said adapter and said insert for adjusting said level of the printing side of said further stamp characters provided on said insert relative to said plane of said supporting plate.

18. A self-inking hand stamp as set forth in claim 17, wherein said adjustment device comprises adjustment screws capable of being screwed into said adapter, each adjustment screw having a means for connection with said insert.

19. A self-inking hand stamp as set forth in claim 18, wherein said means on each adjustment screw is a head.

20. A self-inking hand stamp as set forth in claim 18, wherein said adapter further comprises guiding sleeves, said adjustment screws being capable of being screwed into said guiding sleeves.

21. A self-inking hand stamp as set forth in claim 18, further comprising holding clamps arranged on said insert, said adjustment screws being rotatable in said holding clamps and being retained fixed against axial displacement therein.

22. A self-inking hand stamp as set forth in claim 1, further comprising positioning elements provided on the rear side of said supporting plate, said positioning elements guiding said adapter when it is placed on the rear side of said supporting plate and securing said adapter against lateral displacement.

23. A self-inking hand stamp as set forth in claim 22, wherein said positioning elements are pins provided on said rear side of said supporting plate, said adapter having apertures corresponding to said pins, and said pins engaging in said corresponding apertures of said adapter.

24. A self-inking hand stamp as set forth in claim 1, wherein said turning mechanism further comprises turning indentations provided on said inner side of said side walls of said stamp casing next to the guiding slots, and turning pins provided on rims of said supporting plate facing said side walls, auxiliary abutments being provided on said supporting plate and on said side walls, said turning pins, upon initiation of a pivoting movement by said auxiliary abutments, getting into engagement with said turning indentations during upward and downward movements of the stamp unit so as to complete a pivoting movement of said stamp unit.

* * * * *